United States Patent [19]

Kim

[11] 4,373,123

[45] Feb. 8, 1983

[54] STUDDED MOUNTING STRUCTURE FOR SWITCH

[75] Inventor: Syng N. Kim, Hoffman Estates, Ill.

[73] Assignee: Wico Corporation, Niles, Ill.

[21] Appl. No.: 367,290

[22] Filed: Apr. 12, 1982

[51] Int. Cl.[3] ..... H01H 1/26; H01H 13/52

[52] U.S. Cl. ..... 200/159 A; 200/283; 200/DIG. 46

[58] Field of Search ..... 200/159 A, 283, 61.1, 200/61.11, DIG. 46, 293, 296

[56] References Cited

U.S. PATENT DOCUMENTS

| | | | |
|---|---|---|---|
| 2,051,654 | 8/1936 | Sanford et al. | 200/296 |
| 2,489,812 | 11/1949 | Person | 200/30 A |
| 2,610,277 | 9/1952 | Hooker et al. | 200/159 A |
| 2,823,271 | 2/1958 | Wagstaff | 200/283 |
| 3,047,699 | 7/1962 | Patti | 200/159 A |
| 3,099,735 | 7/1963 | Roeser | 200/283 |
| 3,978,303 | 8/1976 | Miyata | 200/283 |

FOREIGN PATENT DOCUMENTS

| | | | |
|---|---|---|---|
| 1487450 | 1/1969 | Fed. Rep. of Germany | 200/340 |

*Primary Examiner*—John W. Shepperd

*Attorney, Agent, or Firm*—Dithmar, Stotland, Stratman & Levy

[57] ABSTRACT

The mounting structure includes a block having a bore therein and a stud thereon, their axes being substantially parallel. A leaf spring switch has two leaf springs carried by a body having a pair of bores. The surfaces of the block and the body are in juxtaposition, with the stud extending into one of the bores in the body and a threaded fastener extending through the other of the bores in the body and into the bore in the block.

7 Claims, 5 Drawing Figures

STUDDED MOUNTING STRUCTURE FOR SWITCH

BACKGROUND OF THE INVENTION

Leaf spring switches have at least two leaf springs which are spaced apart. One of the leaf springs is moved toward the other to cause them to contact, thereby to close the switch. The switch is mounted on a holder which also carries an actuator to cause the above-described movement of the leaf springs. In the past, the holder had two bores aligned with a corresponding pair of bores in the switch body. Screws extend through the holes in the body into the holder thereby attaching the same. Applying two screws undesirably increases the cost of the resultant product and requires more time for assembly.

SUMMARY OF THE INVENTION

It is therefore an important object of the present invention to provide mounting structure for leaf spring switches, which requires the use of a single screw to provide reliable attachment.

In summary, there is provided the combination comprising mounting structure including a block having a block surface and a block bore extending into the block surface, and a stud protruding from the block surface, the axes of the block bore and the stud being substantially parallel; a leaf spring switch having a body and first and second elongated leaf springs carried thereby, the body having a body surface and a pair of substantially parallel body bores spaced apart a distance equal to the distance between the stud and the block bore; the surfaces being in juxtaposition, with the stud extending into one of the body bores, and a threaded fastener extending through the other of the body bores into the block bore.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings, a preferred embodiment thereof from an inspection of which, when considered in connection with the following description, the invention, its construction and operation, and many of its advantages should be readily understood and appreciated.

DESCRIPTION OF THE PREFERRED EMBODIMENT

Figure 1:
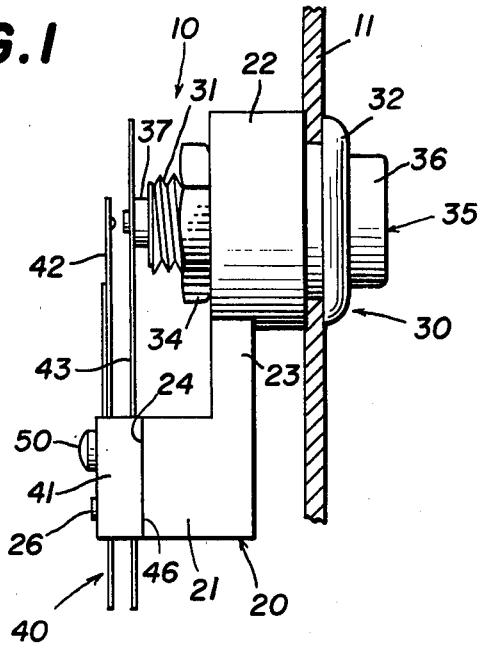
FIG. 1 is an elevational view of a holder incorporating the features of the present invention, the holder carrying a leaf spring switch and an actuator therefor, the holder being attached to a panel shown in fragmentary form.
Figure 2:
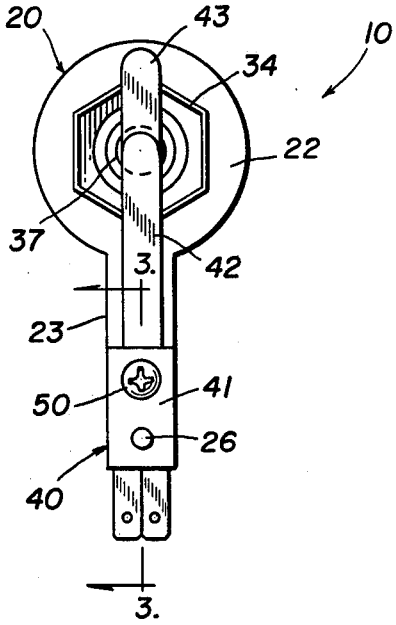
FIG. 2 is a rear plan view of the combination depicted in FIG. 1.
Figure 3:
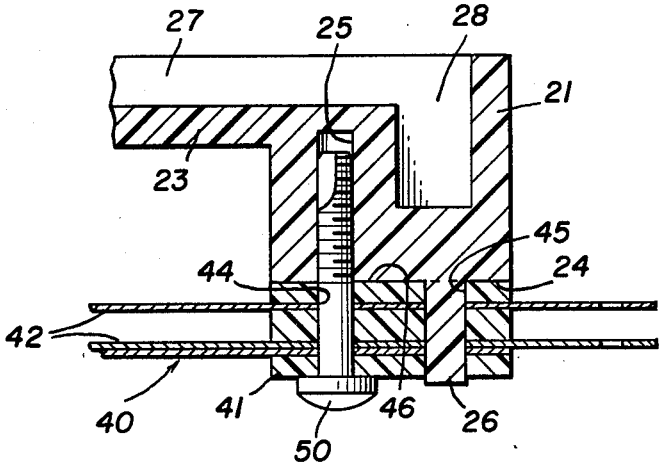
FIG. 3 is a view in cross section, on an enlarged scale, taken along the line 3—3 of FIG. 2.
Figure 4:
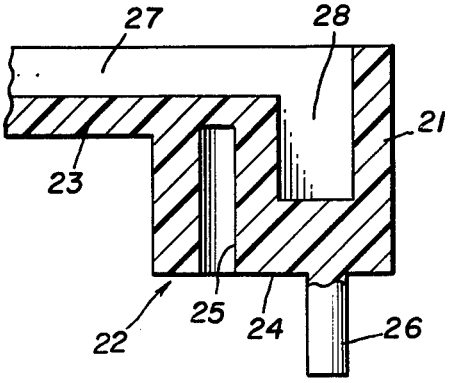
FIG. 4 is a fragmentary view of the mounting block portion of the holder.
Figure 5:
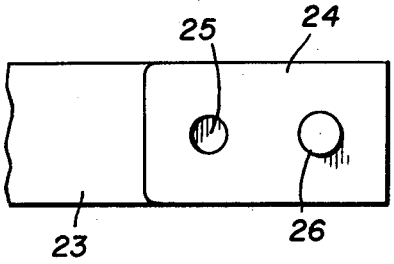
FIG. 5 is a bottom plan view of FIG. 4.

In FIG. 1, there is depicted a switch assembly 10 mounted to a panel 11 such as the side wall of a pinball game. The switch assembly 10 comprises a one-piece holder 20, of plastic, for example, having a mounting block 21, a cylindrical collar 22 and a neck 23 connected between them. The block 21 has a planar, generally rectangular surface 24 into which extends a bore 25 and from which extends a stud 26. The axes of the bore 25 and the stud 26 are substantially parallel. The holder 20 is cut out at 27 and 28 to conserve material. The switch assembly 10 also comprises an actuator housing 30 which includes a threaded stem 31 extending through a hole (not shown) in the collar 22. The actuator housing 30 includes a lip 32 at one end of the stem 31 which bears against the panel 11. A nut 34 threaded onto the stem 31 holds the lip 32 tight against one side of the panel 11 and the collar 22 against the other side. The housing 30 carries a one-piece actuator 35 which includes a button 36 and a plunger 37. The actuator housing 30 carries a spring (not shown) which urges the actuator 35 outwardly (to the right as viewed in FIG. 1). The button 36 may be depressed against the action of such spring to move the plunger 37 to the left.

The switch assembly 10 further comprises a leaf spring switch 40 which includes a body 41 carrying a pair of spaced-apart leaf springs 42 and 43. Extending through the body 41 is a pair of substantially parallel bores 44 and 45 spaced apart a distance equal to the distance between the bore 25 and the stud 26. The body 41 has a planar surface 46 which is substantially the same shape as that of the surface 24 and is in juxtaposition therewith. The stud 26 extends into the bore 45. A self-tapping screw 50 extends through the bore 44 in the body 41 into the bore 25 in the holder 20. The stud 26 orients the switch body 41 and in combination with the screw 50 prevents the body 41 from rotating.

Also, the stud 26 defines an axis of rotation about which the switch 40 is turned until the remaining bore therein is aligned with the bore in the holder, thereby decreasing the time necessary to assemble the switch.

In the preferred embodiment, the diameter of the stud 26 substantially matches the diameter of the bore 45 in order to provide a tight frictional fit. Also the length of the stud 26 is slightly greater than the width of the body 41 so that it protrudes slightly.

What has been described therefore is an improved means for mounting a leaf spring switch to a pinball game, for example, by utilizing a holder that facilitates rapid and inexpensive mounting.

I claim:

1. The combination comprising mounting structure including a block of unitary one-piece construction having a neck with a mounting collar at the distal end thereof and a block surface and a block bore extending into said block surface and a stud protruding from said block surface, the axes of said block bore and said stud being substantially parallel; a leaf spring switch having a body and first and second elongated leaf springs carried thereby, said body having a body surface and a pair of substantially parallel body bores spaced apart a distance equal to the distance between said stud and said block bore, said surfaces being in juxtaposition, with said stud extending into one of said body bores; and a threaded fastener extending through the other of said body bores into said block bore.

2. The combination of claim 1, wherein the diameter of said stud is approximately the same as the diameter of said one body bore to provide a tight frictional fit between said body and said stud.

3. The combination of claim 1, wherein said body and said block are generally rectangular in transverse cross section and have substantially the same dimensions.

4. The combination of claim 1, and further comprising an actuator housing integral with said collar, and an actuator carried by said actuator housing for moving one of said leaf springs into contact with the other of said leaf springs.

5. Mounting structure for use in mounting a leaf spring switch having a body and first and second elongated leaf springs carried thereby, the body having a body surface and a pair of spaced-apart substantially parallel body bores, said mounting structure comprising a mounting block of unitary one-piece construction having a neck with a mounting collar at the distal end thereof and a block surface and a block bore extending into said block surface and a stud protruding from said block surface, the axes of said block bore and said stud being substantially parallel, the distance between said stud and said block bore being equal to the distance between the body bores, in use said block surface being in juxtaposition with the body surface and said stud extending into one of the body bores, a threaded fastener extending through the other of the body bores into said block bore, an actuator housing integral with said collar, and an actuator carried by said actuator housing for moving one of said leaf springs into contact with the other of said leaf springs.

6. The mounting structure of claim 5, wherein the diameter of said stud is approximately the same as the diameter of said one body bore to provide a tight frictional fit between said body and said stud.

7. The mounting structure of claim 5, wherein said body and said mounting block are generally rectangular in transverse cross section and have substantially the same dimensions.

* * * * *